US012103798B2

(12) United States Patent
Farrell

(10) Patent No.: US 12,103,798 B2
(45) Date of Patent: Oct. 1, 2024

(54) DISPENSER

(71) Applicant: Matthew Farrell, Brisbane (AU)

(72) Inventor: Matthew Farrell, Brisbane (AU)

( * ) Notice: Subject to any disclaimer, the term of this patent is extended or adjusted under 35 U.S.C. 154(b) by 210 days.

(21) Appl. No.: 17/774,653

(22) PCT Filed: Oct. 13, 2020

(86) PCT No.: PCT/AU2020/051100
§ 371 (c)(1),
(2) Date: May 5, 2022

(87) PCT Pub. No.: WO2021/087550
PCT Pub. Date: May 14, 2021

(65) Prior Publication Data

US 2022/0371844 A1 Nov. 24, 2022

(30) Foreign Application Priority Data

Nov. 6, 2019 (AU) ..... 2019101365
Nov. 6, 2019 (AU) ..... 2019261736

(51) Int. Cl.
*B65H 16/00* (2006.01)
*B65H 16/06* (2006.01)
*B65H 75/16* (2006.01)
*B65H 75/44* (2006.01)

(52) U.S. Cl.
CPC ..... *B65H 16/005* (2013.01); *B65H 16/06* (2013.01); *B65H 75/16* (2013.01); *B65H 75/4471* (2013.01); *B65H 75/4492* (2013.01); *B65H 2301/41346* (2013.01); *B65H 2402/443* (2013.01); *B65H 2601/25* (2013.01); *B65H 2701/1752* (2013.01); *B65H 2801/51* (2013.01)

(58) Field of Classification Search
CPC ..... B65H 75/16; B65H 75/4492; B65H 2801/51; B65H 16/005; B65H 16/06
See application file for complete search history.

(56) References Cited

U.S. PATENT DOCUMENTS 2,737,291 A * 3/1956 Rochestie ..... B65D 85/66 206/416
3,679,110 A 7/1972 Stine
4,034,929 A * 7/1977 Ebner, Jr. ..... B65H 16/005 242/918
4,537,366 A * 8/1985 Swenson ..... B65H 75/16 206/226
5,904,329 A * 5/1999 Kanome ..... B65D 85/672 248/309.2

(Continued)

FOREIGN PATENT DOCUMENTS

KR 10-2019-0043235 A 4/2019

OTHER PUBLICATIONS

International Search Report and Written Opinion for International Application No. PCT/AU2020/051100 dated Nov. 27, 2020, 8 pages.

*Primary Examiner* — William A. Rivera
(74) *Attorney, Agent, or Firm* — Wegman Hessler Valore

(57) ABSTRACT

A dispenser for dispensing plastic film for vehicle repair, the dispenser including: a first support adapted to rotatably support a roll of plastic film, and an aperture, wherein the plastic film can be pulled through the aperture from the roll and retracted through the aperture towards the roll.

14 Claims, 6 Drawing Sheets

(56) References Cited

U.S. PATENT DOCUMENTS

| | | | | |
|---|---|---|---|---|
| 6,003,668 | A * | 12/1999 | Joyce | B65D 85/672 206/397 |
| 6,749,097 | B1 * | 6/2004 | McElhinny | B65H 35/002 225/25 |
| 7,347,395 | B2 * | 3/2008 | Horn | B65D 83/0805 242/598.5 |
| 9,221,646 | B1 | 12/2015 | Amara | |
| 2007/0176042 | A1 * | 8/2007 | Briante | B65H 16/06 242/588.6 |
| 2015/0344217 | A1 * | 12/2015 | Knez | B65D 85/672 206/397 |
| 2016/0340147 | A1 * | 11/2016 | Sabol | A47J 47/16 |
| 2022/0297970 | A1 * | 9/2022 | Galvez | B65D 83/0882 |

* cited by examiner

DISPENSER

CROSS REFERENCE TO RELATED APPLICATION

This application is a national phase of International Patent Application No. PCT/AU2020/051100 filed Oct. 13, 2020, which claims the priority filing benefit of Australian Patent Application Nos. 2019101365 and 2019261736 filed Nov. 6, 2019, which are incorporated herein by reference in their entirety.

FIELD OF INVENTION

The present invention relates to a dispenser. The present invention has particular but not exclusive application for a dispenser of dispensing plastic film for vehicle repair. The patent specification describes this use but it is by way of example only and the invention is not limited to this use.

BACKGROUND OF THE INVENTION

When vehicles are damaged, it is often necessary to repair the damage and paint the affected area. Typically repairs include spray painting the affected area and covering the other areas of the vehicle to avoid overspray.

Typically, vehicle is covered with plastic film or paper, and then a portion of the plastic film or paper that covers the area to be painted is cut out. After the repair is completed, the entire plastic film or paper is discarded.

The problem within using plastic film is that the plastic is harmful to the environment and it cannot be easily recycled. The problem within using paper is that it greatly increases expense and paper with paint on it cannot be easily recycled.

OBJECT OF THE INVENTION

It is an object of the present invention to overcome or at least alleviate one or more of the above mentioned problems with vehicle repair and/or provide the consumer with a useful or commercial choice.

SUMMARY OF THE INVENTION

In one aspect, the present invention broadly resides in a dispenser for dispensing plastic film for vehicle repair, the dispenser including:

a first support adapted to rotatably support a roll of plastic film, and an aperture, wherein the plastic film can be pulled through the aperture from the roll and retracted through the aperture towards the roll.

In one embodiment, the first support is a rod. Preferably the first support operatively supports the roll of plastic film. Preferably the first support can be located through a central opening of the roll of plastic film.

Preferably the first support is longer than the roll of the plastic film. Alternatively, the first support can be two short rods to operatively support ends of the roll of plastic film.

Preferably the first support is rotatable relative to the aperture. Preferably rotation of the first support in a first direction causes the plastic film to be retracted through the aperture. Preferably rotation of the first support in a first direction causes the plastic film to be wrapped around the first support.

Preferably the dispenser further includes one or more handles. Preferably each of the handles is operatively associated with the first support. Preferably in use, rotation of the one or more handles causes rotation of the first support. Preferably rotation of the one or more handles in a first direction causes the plastic film to be retracted through the aperture. Preferably rotation of the one or more handles in a first direction causes the plastic film to be wrapped around the first support.

In another embodiment, the first support is a first bracket. The first bracket is preferably adapted to operatively support the roll of plastic film by supporting an end of the roll of plastic film. Preferably the first bracket has one or more recesses to support the roll of plastic film, or a portion associated with the roll or plastic film.

Preferably the dispenser further includes a second bracket. The second bracket is preferably adapted to operatively support the roll of plastic film by supporting an opposed end of the roll of plastic film. Preferably the second bracket has one or more recesses to support the roll of plastic film, or a portion associated with the roll or plastic film.

Preferably the dispenser further includes a guide portion. The guide portion preferably defines the aperture.

Preferably the dispenser further includes a base member. The base member is preferably adapted to support the first bracket and the second bracket.

Preferably the aperture is circular in shape. Alternatively, the aperture can be other shapes that the plastic film can be easily pulled through, for example the aperture can be oval, rectangle or the like in shape.

Preferably the first support is substantially made of a metallic material. Alternatively, the first support can be made of other materials, such as plastic or a composite material or the like.

Preferably each of the handles is substantially made of a metallic material. Alternatively, each of the handles can be made of other materials, such as plastic or a composite material or the like.

Preferably the first bracket and the second bracket are substantially made of a metallic material. Alternatively, the first bracket and the second bracket can be made of other materials, such as plastic or a composite material or the like.

Preferably the guide portion is substantially made of a metallic material. Alternatively, the guide portion can be made of other materials, such as plastic or a composite material or the like.

Preferably the base member is substantially made of a metallic material. Alternatively, the base member can be made of other materials, such as plastic or a composite material or the like.

Preferably the dispenser further includes a plastic film protection member. Preferably the plastic film protection member is located adjacent an edge of the aperture to prevent the plastic film from being damaged while moving through the aperture.

Preferably the plastic film protection member has a circular cross section or an arcuate portion to prevent the plastic film from being damaged while moving through the aperture. Alternatively, the plastic film protection member can be any other suitable shapes that inhibits contact between the plastic film and sharp edges.

Preferably the plastic film protection member further includes one or more protrusions. Preferably the one or more protrusions attach the plastic film protection member to a portion of the dispenser. Preferably the one or more protrusions attach the plastic film protection member to a portion of the guide member.

In another aspect, the present invention broadly resides in a dispenser for dispensing plastic film for vehicle repair, the dispenser including:

a first support adapted to rotatably support a roll of plastic film, an aperture, wherein the plastic film can be pulled through the aperture from the roll and retracted through the aperture towards the roll, and a case, wherein the roll of plastic film is rotatably located within the case.

Preferably the dispenser further includes a cover. The cover preferably defines the aperture.

In one embodiment, the first support is rotatable relative to the aperture. Preferably rotation of the first support in a first direction causes the plastic film to be retracted through the aperture. Preferably rotation of the first support in a first direction causes the plastic film to be wrapped around the first support.

Preferably the first support at least partially encases the roll of plastic film. Preferably the first support has an internal space. Preferably the first support has a lid which can be opened to insert the roll of plastic film into the internal space. Preferably the first support includes an opening through which the plastic film can be pulled out. Preferably in a closed position, the lid defines the opening that the plastic film can be pulled through. In one embodiment, a cardboard box in which the roll of plastic film is contained is used as the first support.

Preferably the first support is rotatable relative to the case. Preferably the case further includes one or more holes in the side walls. Each of the holes is preferably adapted to support the first support. Preferably the first support is removably mounted to the one or more holes to support the roll of plastic film.

Preferably the cover is adapted to cover an opening of the case. Preferably the cover is movably attached to the case. Alternatively, the cover and the case can be integrally formed, with a flexible portion between the cover and the case.

Preferably the dispenser further includes one or more handles. Preferably each of the handles is operatively associated with the first support. Preferably in use, rotation of the one or more handles causes rotation of the first support. Preferably rotation of the one or more handles in a first direction causes the plastic film to be retracted through the aperture. Preferably rotation of the one or more handles in a first direction causes the plastic film to be wrapped around the first support.

In another embodiment, the first support is a rod. Preferably the first support operatively supports the roll of plastic film by locating through a central opening of the roll of plastic film.

Preferably the first support is longer than the roll of the plastic film. Alternatively, the first support can be two short rods to operatively support ends of the roll of plastic film.

Preferably the first support is rotatable relative to the aperture. Preferably rotation of the first support in a first direction causes the plastic film to be retracted through the aperture. Preferably rotation of the first support in a first direction causes the plastic film to be wrapped around the first support.

Preferably the dispenser further includes one or more handles. Preferably each of the handles is operatively associated with the first support. Preferably in use, rotation of the one or more handles causes rotation of the first support. Preferably rotation of the one or more handles in a first direction causes the plastic film to be retracted through the aperture. Preferably rotation of the one or more handles in a first direction causes the plastic film to be wrapped around the first support.

Preferably the aperture is circular in shape. Alternatively, the aperture can be other shapes that the plastic film can be easily pulled through, for example the aperture can be oval, rectangle or the like in shape.

Preferably the first support is substantially made of a metallic material. Alternatively, the first support can be made of other materials, such as plastic or a composite material or the like.

Preferably the cover and the case are substantially made of a metallic material. Alternatively, the cover and the case can be made of other materials, such as plastic or a composite material or the like.

Preferably each of the handles is substantially made of a metallic material. Alternatively, each of the handles can be made of other materials, such as plastic or a composite material or the like.

Preferably the dispenser further includes a plastic film protection member. Preferably the plastic film protection member is located adjacent an edge of the aperture to prevent the plastic film from being damaged while moving through the aperture.

Preferably the plastic film protection member has a circular cross section or an arcuate portion to prevent the plastic film from being damaged while moving through the aperture. Alternatively, the plastic film protection member can be any other suitable shapes that inhibits contact between the plastic film and sharp edges.

Preferably the plastic film protection member further includes one or more protrusions. Preferably the one or more protrusions attach the plastic film protection member to a portion of the dispenser. Preferably the one or more protrusions attach the plastic film protection member to a portion of the guide member.

In one embodiment, the plastic film protection member is moulded into the cover. Preferably the plastic film protection member is made of a plastic material. Preferably the cover is made of a plastic material.

In a further aspect, the present invention broadly resides in a method of dispensing plastic film for vehicle repair, the method including the steps of rotatably mounting a roll of plastic film relative to an aperture, pulling the plastic film from the roll and through the aperture, and retracting the plastic film through the aperture towards the roll.

Preferably the method further includes the step of supporting the roll of plastic film with a first support.

Preferably the method further includes the step of locating the roll of plastic film inside a case.

Preferably the method further includes the step of rotating one or more handles to rotate the first support.

Preferably the method further includes the step of cutting a used portion of the plastic film from the roll of plastic film. Preferably the used portion includes openings which inhibit the used portion from being reused. Preferably the plastic film without openings can be reused.

Preferably the method further includes the step of rotating the one or more handles in a first direction to retract the plastic film through the aperture. Preferably the method further includes the step of rotating the one or more handles in a first direction to wrap the plastic film around the first support.

Preferably the method further includes the step of rotating the one or more handles in a first direction to retract the plastic film through the aperture into the case.

Preferably the plastic film is dispensed using a dispenser as described in this specification.

The features described with respect to one aspect also apply where applicable to all other aspects of the invention. Furthermore, different combinations of described features are herein described and claimed even when not expressly stated.

BRIEF DESCRIPTION OF THE DRAWINGS

In order that the present invention can be more readily understood reference will now be made to the accompanying drawings which illustrate a preferred embodiment of the invention and wherein.

DETAILED DESCRIPTION OF THE PREFERRED EMBODIMENT

Figure 1:
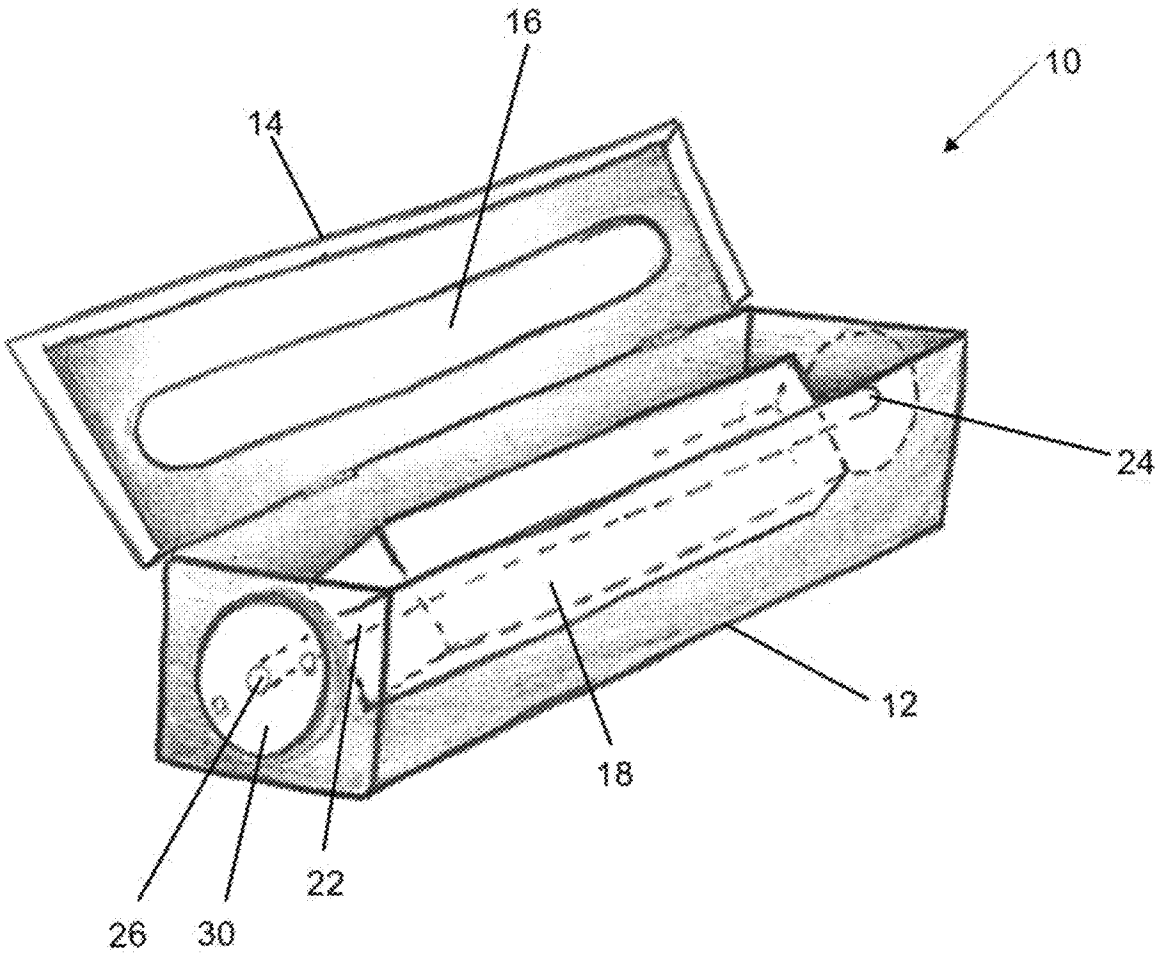
FIG. 1 is a perspective view of a dispenser according to a preferred embodiment of the present invention.
Figure 2:
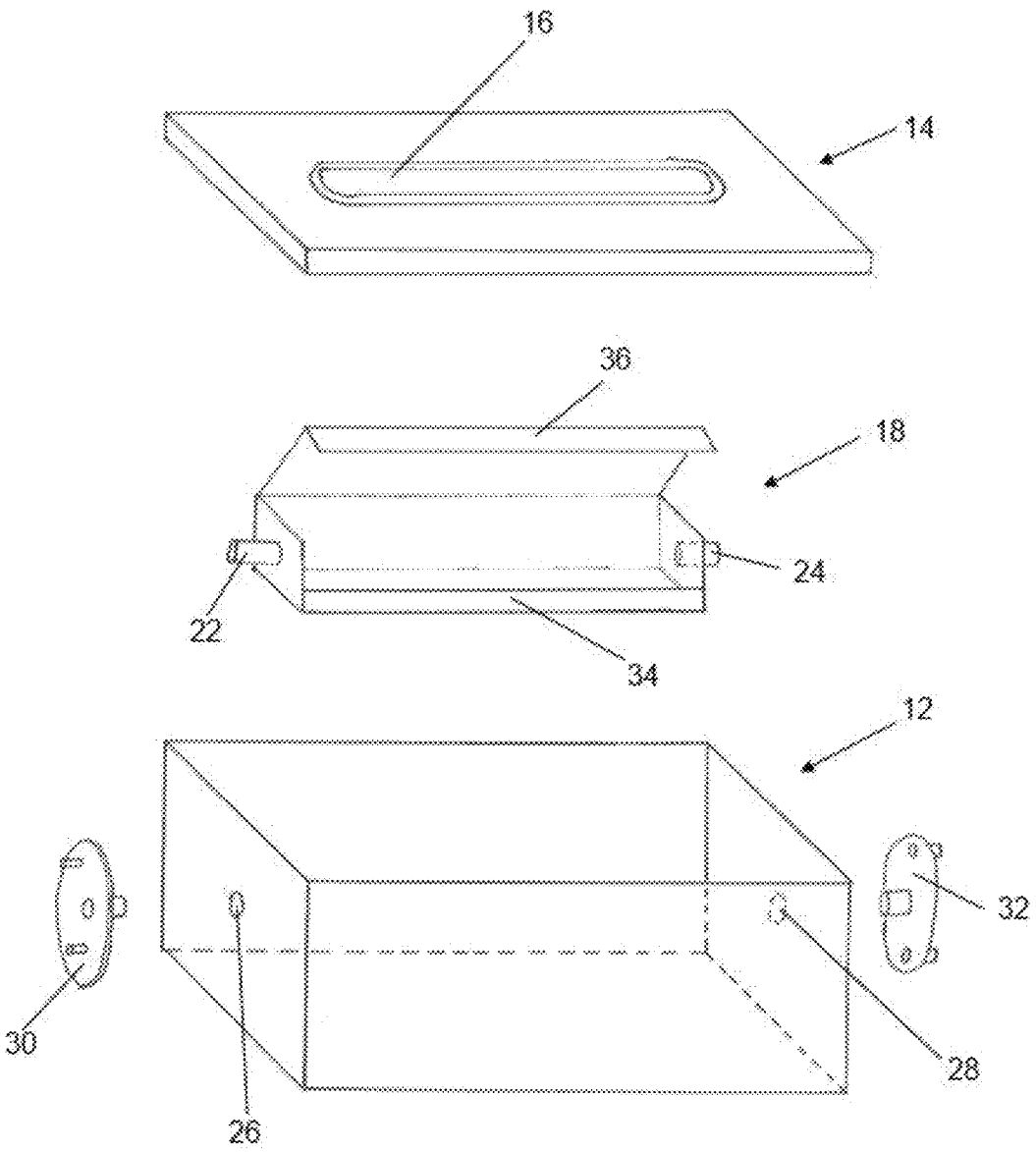
FIG. 2 is an exploded view of the dispenser of FIG. 1.

With reference to FIGS. 1 to 2, there is a shown a dispenser 10 according to a preferred embodiment of the present invention. The dispenser 10 includes a case 12 and a cover 14. The cover 14 defines an aperture 16. The dispenser 10 also includes a first support in the form of a container 18. The container 18 is rotatably located in the case 12 to rotatably support a roll of plastic film (not shown).

The container 18 includes two portions 22,24. The two portions 22,24 are adapted to rotatably support the container 18 within the case 12.

In use, the plastic film can be pulled through the aperture 16 from the roll of plastic film, and the plastic film can be retracted through the aperture 16 towards the roll of plastic film.

The case 12 includes mounting means in the form of mounting holes 26,28. The mounting holes 26,28 are adapted to support the two portions 22,24.

The dispenser 10 further includes handles 30,32. The handles 30,32 are operatively associated with the two portions 22,24. In use, rotation of the one of the handles 30,32 in a first direction causes rotation of the container 18 in the first direction. Rotation of the container 18 in the first direction causes the plastic film to be retracted through the aperture 16 and wrapped around the container 18.

The container 18 further includes a body 34 and a lid 36. The body 34 and the lid 36 define an internal space to contain the roll of plastic film. The lid 36 is adapted to partially cover an opening of the body 34. In a closed position, the body 34 and the lid 36 define the opening that the plastic film can be pulled out through.

Figure 3:
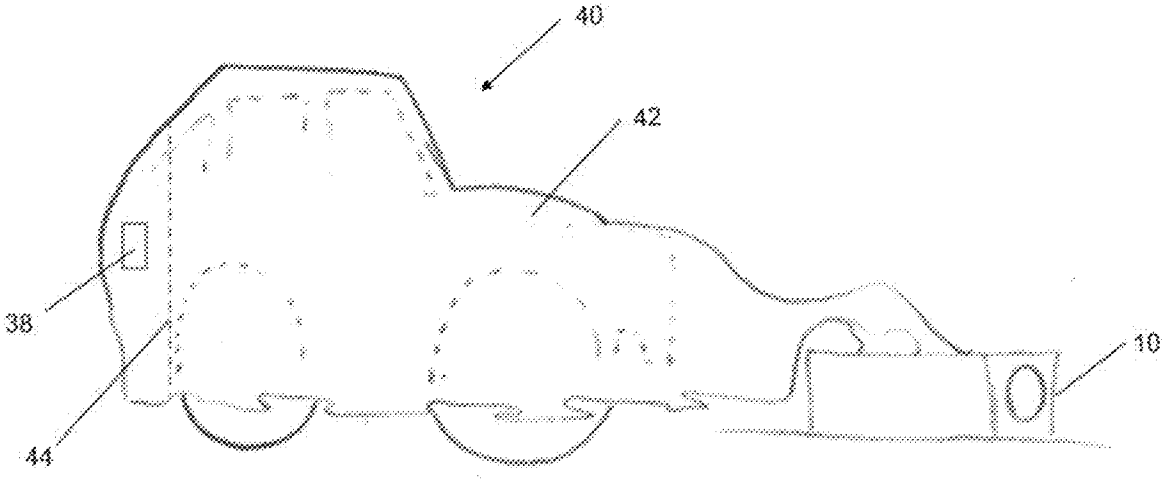
FIG. 3 shows a vehicle repair using the dispenser of FIG. 1.
Figure 4:
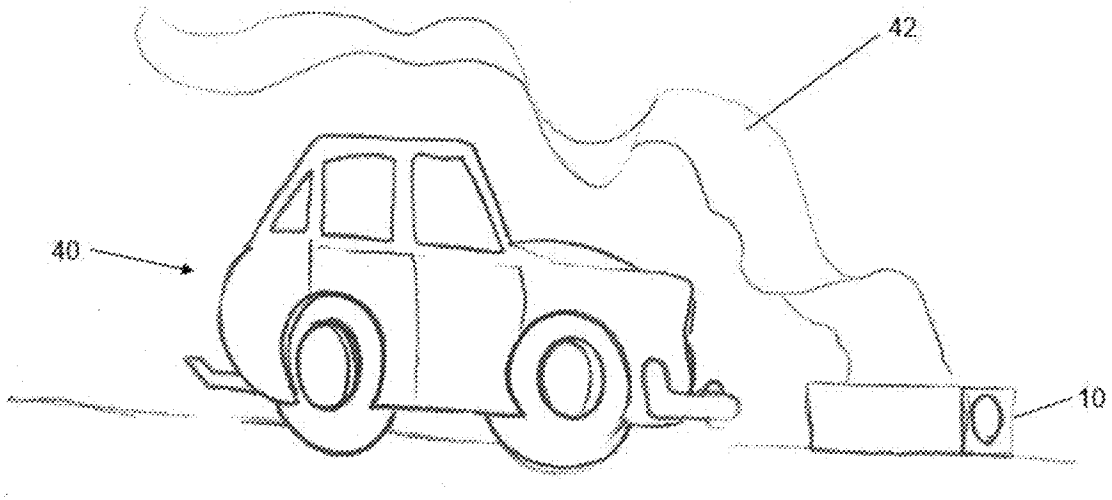
FIG. 4 shows plastic film retraction using the dispenser of FIG. 1.

With reference to FIG. 3, there is shown a vehicle repair using the dispenser 10. A plastic film 42 is pulled through the aperture 16 from the dispenser 10 to cover the entire vehicle body 40. A portion of the plastic film 42 that covers the area to be repaired 38 is cut out. After the repair is completed, the plastic film 42 is cut along line 44, and a portion of the plastic film 42 that contains the cut out for the repair area 38 is discarded. The remaining portion of the plastic film 42 is retracted through the aperture 16 into the dispenser 10, as shown in FIG. 4. This avoids excess waste and allows the plastic film 42 to be reused.

Figure 5:
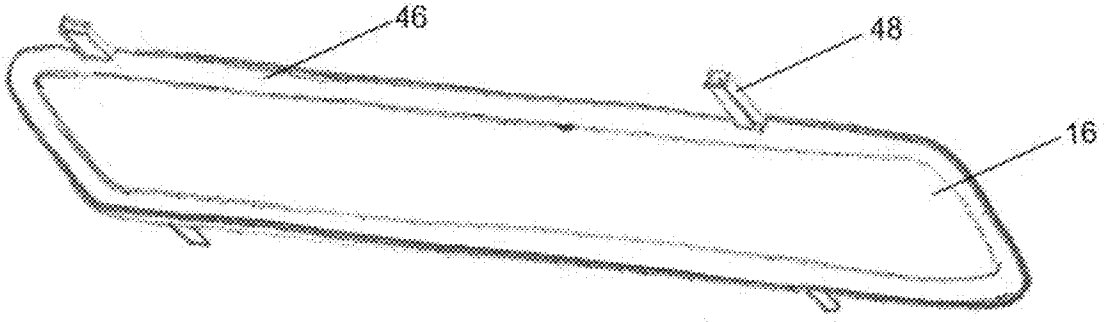
FIG. 5 is a perspective view of the protection member of the dispenser of FIG. 2.

With reference to FIG. 5, there is shown a plastic film protection member 46. The plastic film protection member 46 is located adjacent an edge of the aperture 16 (as shown in FIG. 2). The plastic film protection member 46 has a circular cross section to prevent the plastic film from being damaged while moving through the aperture 16.

The plastic film protection member 46 further includes protrusions 48. The protrusions 48 attach the plastic film protection member 46 to the cover 14 (as shown in FIG. 2).

Figure 6:
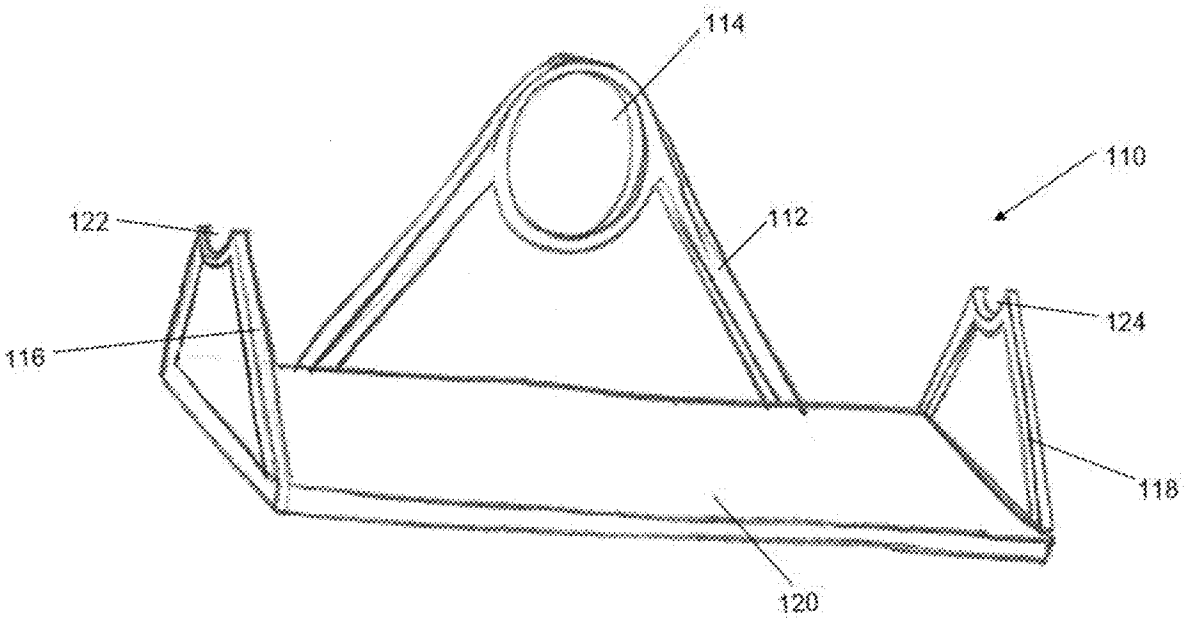
FIG. 6 is a perspective view of a dispenser according to a second preferred embodiment of the present invention.

With reference to FIG. 6, there is a shown a dispenser 110 according to a second embodiment of the present invention.

The dispenser 110 includes a guide portion 112 and a first support in the form of a first bracket 116. The guide portion 112 defines an aperture 114. The dispenser 110 further includes a second support in the form of a second bracket 118. The first bracket 116 is adapted to support an end of a roll of plastic film (not shown). The second bracket 118 is adapted to support an opposed end of the roll of plastic film.

The first bracket 116 and the second bracket 118 further include a recess 122,124 respectively. The recesses 122,124 are adapted to support the roll of plastic film.

The dispenser 110 further includes a base member 120. The first bracket 116 and the second bracket 118 extend from the base member 120. The guide portion 112 extends from the base member 120.

Advantages

An advantage of the preferred embodiment of the dispenser includes that plastic film can be recycled to avoid waste. Another advantage of the preferred embodiment of the dispenser includes that used plastic film can be retracted and wrapped around the first support, such that unused plastic film is not affected by the used plastic film. A further advantage of the preferred embodiment is that it is easy for people to retract the plastic film by rotating the first support.

Variations

While the foregoing has been given by way of illustrative example of this invention, all such and other modifications and variations thereto as would be apparent to persons skilled in the art are deemed to fall within the broad scope and ambit of this invention as is herein set forth.

Throughout the description and claims of this specification the word "comprise" and variations of that word such as "comprises" and "comprising", are not intended to exclude other additives, components, integers or steps.

The invention claimed is:

1. A dispenser for dispensing plastic film for vehicle repair, the dispenser comprising:

a case; and a container rotatably located within the case, the container adapted to rotatably support a roll of plastic film;

wherein the case defines an aperture, wherein the plastic film can be pulled through the aperture from the roll and retracted through the aperture towards the roll;

wherein, in use, the plastic film is wrapped around the container when retracted through the aperture.

2. The dispenser as claimed in claim 1, wherein the case has a cover and the cover defines the aperture.

3. The dispenser as claimed in claim 1, further including one or more handles operatively associated with the container, and wherein rotation of the one or more handles causes rotation of the container.

4. The dispenser as claimed in claim 1, further including a plastic film protection member.

5. The dispenser as claimed in claim 4, wherein the plastic film protection member is located adjacent an edge of the aperture to prevent the plastic film from being damaged while moving through the aperture.

6. The dispenser as claimed in claim 1, wherein the container includes a rod, and wherein the rod is located through a central opening of the roll of plastic film to support the roll of plastic film.

7. The dispenser as claimed in claim 1, further including one or more handles.

8. The dispenser as claimed in claim 7, wherein each of the handles is operatively associated with the container, and rotation of the one or more handles causes rotation of the container.

9. The dispenser as claimed in claim 1, wherein the container comprises a first bracket adapted to operatively support the roll of plastic film by supporting an end of the roll of plastic film.

10. The dispenser as claimed in claim 9, further including a second bracket adapted to operatively support the roll of plastic film by supporting an end of the roll of plastic film opposite to the end of the roll of plastic film supported by the first bracket.

11. The dispenser as claimed in claim 1, wherein the container at least partially encases the roll of plastic film, and has an opening through which the plastic film can be pulled out.

12. A method of dispensing plastic film for vehicle repair, the method comprising the steps of:

locating a roll of plastic film inside a container;

locating the container inside a case;

rotatably mounting the roll of plastic film relative to an aperture of the case;

pulling plastic film from the roll and through the aperture; and rotating one or more handles to rotate the container, wherein the one or more handles are rotated in a first direction to retract the plastic film through the aperture towards the roll and wrap the plastic film around the container.

13. The method as claimed in claim 12, wherein the one or more handles are rotated in a first direction to retract the plastic film through the aperture and into the case.

14. The method as claimed in claim 12, further comprising the step of cutting a used portion of the plastic film from the roll of plastic film.

* * * * *